US009568010B2

(12) United States Patent
Adhvaryu et al.

(10) Patent No.: US 9,568,010 B2
(45) Date of Patent: Feb. 14, 2017

(54) INLET DESIGN FOR A PUMP ASSEMBLY

(75) Inventors: Ketan G. Adhvaryu, Sterling Heights, MI (US); Murray Busato, Clinton Township, MI (US); Robert D. Keefover, Lake Orion, MI (US); Brian M. Chomicz, St. Clair Shores, MI (US)

(73) Assignee: BorgWarner Inc., Auburn Hills, MI (US)

( * ) Notice: Subject to any disclaimer, the term of this patent is extended or adjusted under 35 U.S.C. 154(b) by 694 days.

(21) Appl. No.: 13/363,922

(22) Filed: Feb. 1, 2012

(65) Prior Publication Data

US 2013/0195606 A1 Aug. 1, 2013

(51) Int. Cl.

| | |
|---|---|
| ***F04D 23/00*** | (2006.01) |
| ***F04D 29/42*** | (2006.01) |
| ***F04D 29/44*** | (2006.01) |
| ***F04D 29/70*** | (2006.01) |

(52) U.S. Cl.

CPC ..... *F04D 23/008* (2013.01); *F04D 29/4213* (2013.01); *F04D 29/441* (2013.01); *F04D 29/701* (2013.01); *F05D 2250/51* (2013.01)

(58) Field of Classification Search

CPC ..... F04D 5/002; F04D 5/007; F04D 23/008; F04D 29/701; F04D 29/441; F04D 29/4213; F05B 2250/503; F05B 2250/50; F05B 2250/501

USPC ..... 415/1, 52.1, 55.1, 55.2, 55.3, 55.4, 58.2,415/58.3, 184, 5.5, 55.7

See application file for complete search history.

(56) References Cited

U.S. PATENT DOCUMENTS

| | | | | |
|---|---|---|---|---|
| 2,056,553 | A * | 10/1936 | Abramson | 415/184 |
| 2,724,338 | A * | 11/1955 | Roth | 415/55.5 |
| 2,842,062 | A * | 7/1958 | Wright | 415/11 |
| 3,915,589 | A * | 10/1975 | Vander Linden | 415/55.4 |
| 4,306,833 | A * | 12/1981 | Sixsmith | F04D 5/002 415/55.3 |
| 4,334,821 | A * | 6/1982 | Sixsmith | F04D 5/002 415/55.1 |
| 4,408,952 | A * | 10/1983 | Schweinfurter | 415/55.6 |
| 6,974,301 | B2 * | 12/2005 | Suzuki et al. | 415/55.1 |
| 7,513,741 | B2 * | 4/2009 | Smiley et al. | 415/205 |
| 7,837,430 | B2 * | 11/2010 | Cattani | 415/55.2 |
| 2004/0096316 | A1 * | 5/2004 | Simon et al. | 415/151 |
| 2009/0047125 | A1 * | 2/2009 | Chien | 415/208.1 |
| 2010/0086396 | A1 | 4/2010 | Peterson et al. | |
| 2010/0172777 | A1 | 7/2010 | Adhvaryu et al. | |
| 2012/0294703 | A1 * | 11/2012 | Lei et al. | 415/1 |

OTHER PUBLICATIONS

U.S. Appl. No. 13/363,946, filed Feb. 1, 2012 ; Title: Inlet Design for a Pump Assembly ; Inventors : Ketan G.Adhvaryu, Murray Busato, Robert D. Keefover, Brian M. Chomicz.

* cited by examiner

*Primary Examiner* — Igor Kershteyn
*Assistant Examiner* — Eldon Brockman
(74) *Attorney, Agent, or Firm* — BrooksGroup

(57) ABSTRACT

One embodiment includes an air pump assembly (10) with an impeller (12), a housing (16), and a diverter (18). The impeller (12) has an axis of rotation (R). The housing (16) surrounds the impeller (12) and has an inlet passage (42) with a longitudinal axis ($L_1$) arranged generally orthogonal to the axis of rotation (R) of the impeller (12). The diverter (18) helps reduce turbulent fluid-flow in the inlet passage (42).

20 Claims, 6 Drawing Sheets

INLET DESIGN FOR A PUMP ASSEMBLY

TECHNICAL FIELD

The technical field generally relates to inlet designs for pump assemblies.

BACKGROUND

Pump assemblies having impellers are sometimes designed with an inlet passage that feeds fluid orthogonally relative to an axis of rotation of the impeller. One example of such a pump assembly is a secondary air pump assembly that supplies secondary or intake air to an automotive exhaust system during warm-up of an automotive internal combustion engine, or at other times.

SUMMARY OF ILLUSTRATIVE EMBODIMENTS

One embodiment includes an air pump assembly that may include an impeller, a housing, and a diverter. The impeller may have an axial face, an axis of rotation, and a circumferential periphery. The housing may surround the impeller. The housing may form a part or more of a primary passage for air flow during use of the air pump assembly. The primary passage may be open to the impeller at the axial face of the impeller. The housing may have an inlet passage that may communicate with the primary passage. The inlet passage may have a longitudinal axis that may be arranged generally orthogonal to the axis of rotation of the impeller. The diverter may be located near or closer to the inlet passage. The diverter may have a surface that confronts the axial face of the impeller, that confronts the circumferential periphery of the impeller, or that confronts both the axial face and the circumferential periphery. When the air pump assembly is in use, the diverter may inhibit the generation of turbulent flow between incoming air flow and the impeller where the surface confronts the impeller.

One embodiment includes a method. The method may include providing an air pump assembly that may comprise an impeller and a housing. The impeller may have numerous vanes, an axial face, and an axis of rotation. The vanes may have a circumferential periphery. The housing may form a part or more of a primary passage. The primary passage may be open to the vanes at the axial face. The housing may have an inlet passage with a longitudinal axis that may be arranged generally orthogonal to the axis of rotation of the impeller. The method may also include diverting a portion or more of incoming air flow through the inlet passage away from the circumferential periphery of the vanes, away from the axial face of the impeller, or away from both of the circumferential periphery and the axial face.

One embodiment includes an air pump assembly that may include an impeller, a motor, a housing, and a diverter. The impeller may have numerous vanes, a first axial face, a second axial face, and an axis of rotation. The vanes may have a circumferential periphery. The motor may be connected to the impeller in order to rotate the impeller during use of the air pump assembly. The housing may surround the impeller. The housing may form a part or more of a first primary passage and a part or more of a second primary passage. The first primary passage may be open to the vanes at the first axial face, and the second primary passage may be open to the vanes at the second axial face. The housing may have an inlet passage that may communicate with the first and second primary passages. The housing may have an outlet passage that may communicate with the first and second primary passages. The inlet passage may have a longitudinal axis that may be arranged generally orthogonal to the axis of rotation of the impeller. The diverter may have a surface that may confront the circumferential periphery of the vanes. The surface may have an axial height dimension that may be greater than approximately one-half an axial height dimension of the vanes at the circumferential periphery. The surface may have a circumferential width dimension that may be greater than approximately one-half a diameter dimension of the inlet passage. When the air pump assembly is in use, the diverter may inhibit incoming air flow at the circumferential periphery of the vanes where the surface confronts the circumferential periphery, and the diverter may veer incoming air flow to the first and second primary passages.

Other illustrative embodiments of the invention will become apparent from the detailed description provided hereinafter. It should be understood that the detailed description and specific examples, while disclosing illustrative embodiments of the invention, are intended for purposes of illustration only and are not intended to limit the scope of the invention.

BRIEF DESCRIPTION OF THE DRAWINGS

Illustrative embodiments of the present disclosure will become more fully understood from the detailed description and the accompanying drawings, wherein.

DETAILED DESCRIPTION OF ILLUSTRATIVE EMBODIMENTS

The following description of the embodiment(s) is merely illustrative in nature and is in no way intended to limit the invention, its application, or its uses.

The figures illustrate several embodiments of an inlet design for a pump assembly that may improve fluid-flow efficiencies through the pump assembly compared to known inlet designs, meaning that the inlet designs disclosed herein may produce greater volumetric flow rate for a given power input. The overall size of the pump assembly may therefore be reduced if suitable and desirable for a particular application, while maintaining the same fluid-flow performance of the larger pump assembly with the known inlet design. Of course, the overall size of the pump assembly with the inlet designs disclosed herein need not be reduced, in which case the pump assembly would simply exhibit improved fluid-flow efficiencies and improved performance. The improvements result in part from a reduction in turbulence of incoming fluid-flow, as will be described in greater detail below.

Figure 1:
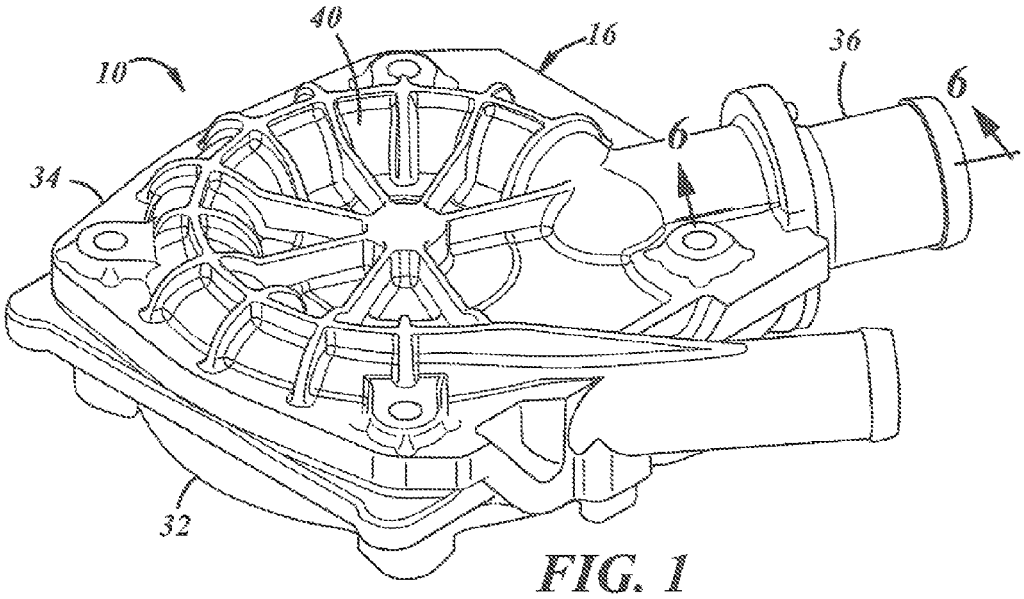
FIG. 1 is a top perspective view of an embodiment of an air pump assembly.
Figure 2:
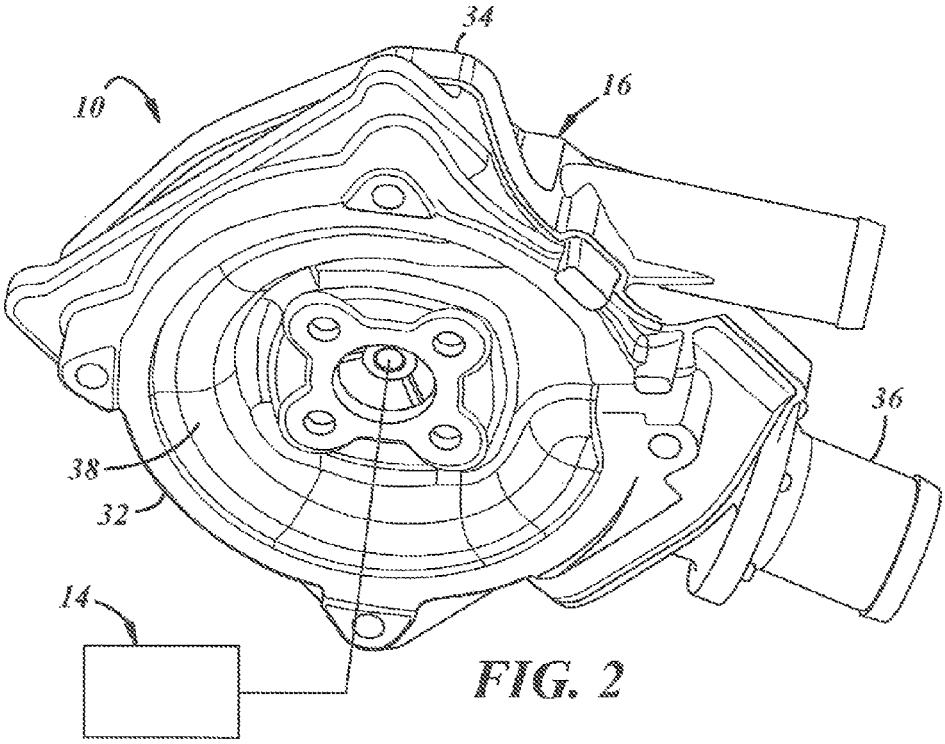
FIG. 2 is a bottom perspective view of the air pump assembly of FIG. 1.

Referring to FIG. 1, the inlet designs described herein may be incorporated into a pump assembly 10. In the embodiments shown in the figures, the pump assembly 10 may be a secondary air pump assembly that is used in a secondary air system of an automotive internal combustion engine exhaust system. Secondary air systems are equipped in engine exhaust systems of automotive internal combustion engines in order to supply intake air to the engines during warm-up modes, during other engine modes, or both. Depending upon the particular application, other components of secondary air systems may include an air filter, an air valve, a catalytic converter, a diesel particulate filter, or a combination thereof. Skilled artisans will understand the general construction, arrangement, and operation of these components and others of secondary air systems such that a more detailed description need not be provided here.

The pump assembly 10 may be of the regenerative pump type. Referring to FIGS. 1-4, in the illustrated embodiment, the pump assembly 10 may include an impeller 12, a motor 14, a housing 16, and a diverter 18.

Figure 3:
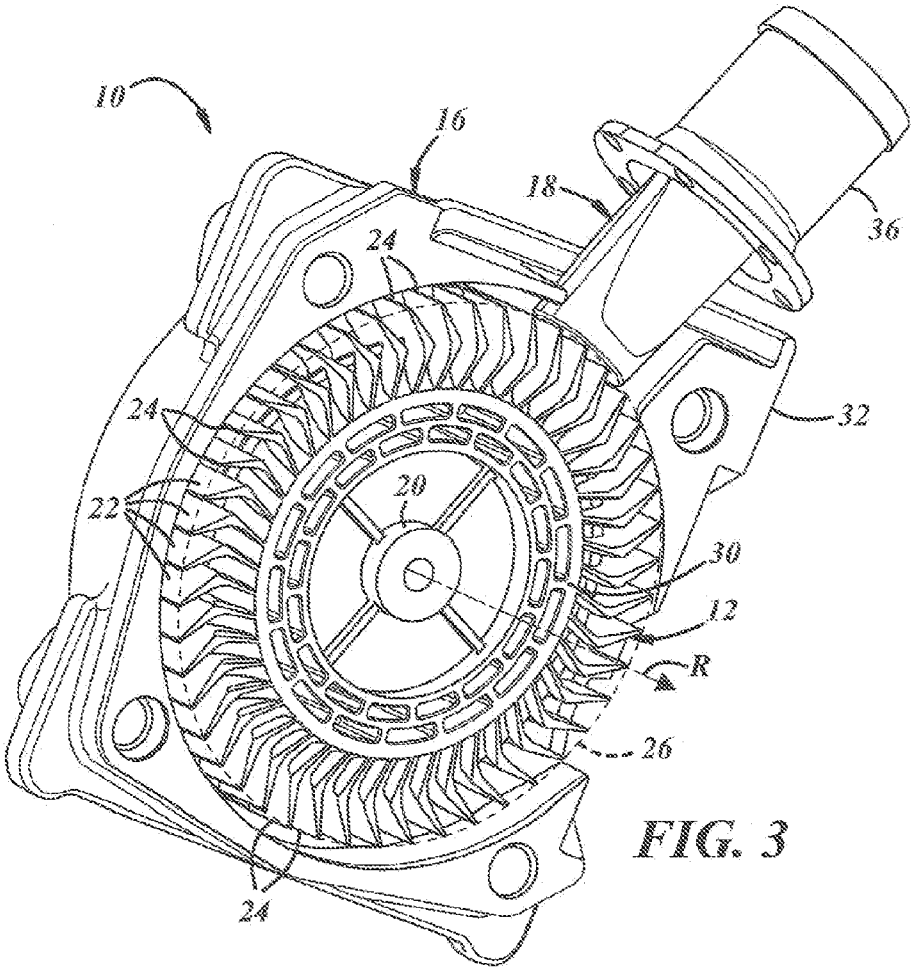
FIG. 3 is a top view of the air pump assembly of FIG. 1 with a cover removed to show an impeller.

Referring in particular to FIG. 3 where a part of the housing 16 is removed for demonstrative purposes, the impeller 12 may be located in the housing and may be rotated by the motor 14 about an axis of rotation R during use of the pump assembly 10. Generally speaking, the impeller 12 may have a somewhat cylindrical shape that defines directions with respect to the shape including a radial direction, an axial direction, and a circumferential direction; as used herein, and unless otherwise specified, the terms radially, axially, circumferentially, and variants thereof, are in reference to the shape of the impeller. The impeller 12 may have different designs and constructions, including that shown in FIGS. 3 and 5. In these figures, the impeller 12 has a body which may have a hub 20 and numerous vanes 22 extending radially outwardly from the hub. The hub 20 may be constructed for connection to a spinning shaft of the motor 14. The vanes 22 may extend circumferentially all-around the hub 20, and may each have a terminal end 24 at a radially-outwardly-most point of the vane. A circumferential periphery 26 may be an imaginary radially-outwardly-most circumference of the impeller 12, and in this embodiment may be defined in part by the terminal ends 24 of the vanes 22. The circumferential periphery 26 may have an axial height dimension A (FIG. 6) which, in this embodiment, is also the axial height dimension of the vanes 22 and of the impeller 12. Lastly, the impeller 12 may also have a first axial face 28 and a second axial face 30. The first and second axial faces 28, 30 may be defined by planar surfaces located at opposite axially-outwardly-most ends of the impeller 12.

The motor 14 may be located outside of the housing 16 and may be mounted to the housing, and may be connected to the impeller 12 in order to provide rotational drive thereto via its spinning shaft. The motor 14 is shown schematically in FIG. 2. The motor 14 may be an electric d.c. motor, or may be another type.

The housing 16 may provide structural support for components of the pump assembly 10. The housing 16 may have different designs and constructions, including that shown in FIGS. 1-3 and 6. In these figures, the housing 16 may be composed of separate and distinct pieces that are attached together via fasteners, welding, heat staking, or other attachment ways. The pieces may be made of a plastic material, and may be formed by injection molding processes. The housing 16 may include a body piece 32, a cover piece 34, and an inlet piece 36; in other embodiments, for example, the inlet piece could be unitary with the body or cover piece, and an outlet piece could also be provided. The body piece 32 may have a first bulged portion 38 that partly defines a fluid-flow passage, as discussed below, and likewise the cover piece 34 may have a second bulged portion 40 that partly defines a fluid-flow passage.

Figure 4:
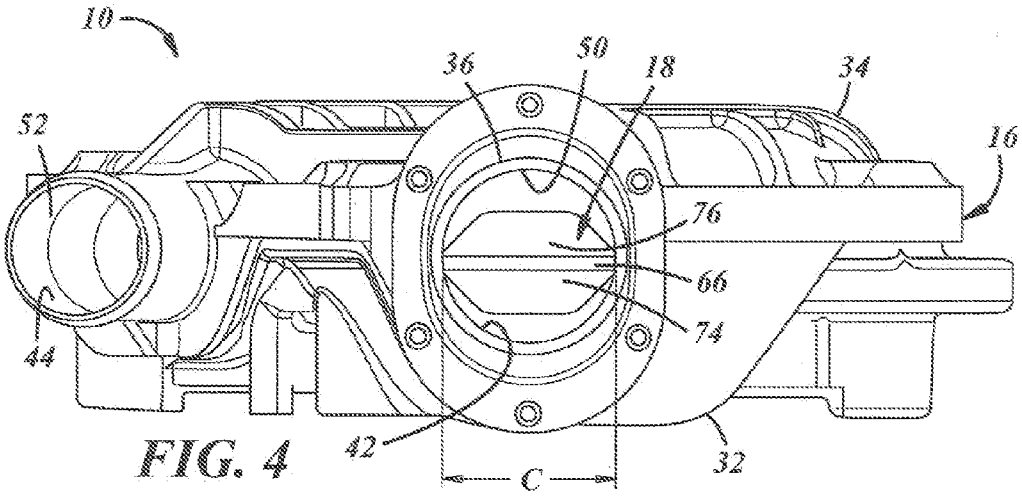
FIG. 4 is a side view of the air pump assembly of FIG. 1.
Figure 6:
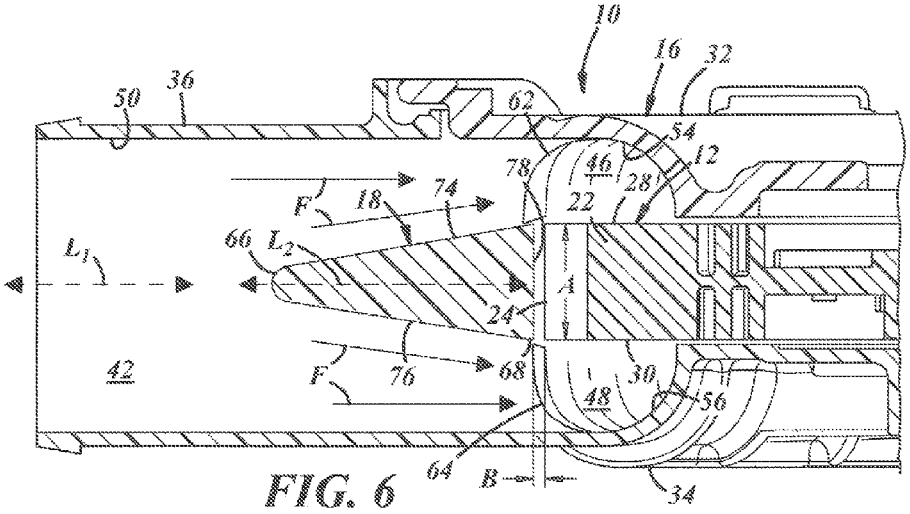
FIG. 6 is a cross-sectional view of the air pump assembly of FIG. 1, showing an embodiment of a diverter.

Furthermore, and as mentioned, the housing 16 may partly define fluid-flow passages of the pump assembly 10. Referring now to FIGS. 4 and 6, the housing 16 may have an inlet passage 42, an outlet passage 44, and a first and second primary passage 46, 48 communicating between the inlet and outlet passages. In other embodiments not shown in the figures, the housing could have a single primary passage instead of two, and could have two inlet passages such as a housing inlet passage arranged generally radially and a cover inlet passage arranged generally axially as disclosed in United States Patent Application Publication Number 2010/0086396 assigned to this applicant BorgWarner Inc. The inlet passage 42 may receive incoming fluid-flow and may be defined by an inlet surface 50. The inlet passage 42 may have a generally cylindrical shape, and in one example may have a diameter dimension of approximately 20 mm; other diameter dimensions are possible and may depend on, among other factors, the particular application. The inlet passage 42 may have a longitudinal axis $L_1$ that may be arranged generally orthogonal to the axis of rotation R of the impeller 12. The orthogonal relationship may include a radial inlet design where the longitudinal axis $L_1$ intersects the axis of rotation R, a tangential inlet design where the longitudinal axis $L_1$ is directed generally tangentially relative to the circumferential periphery 26, and where the longitudinal axis $L_1$ is directed at an angular position therebetween; these orthogonal relationships are disclosed in the International Publication Number WO 2009/006385 to this applicant BorgWarner Inc. In FIG. 6, incoming fluid-flow travels from left to right in the inlet passage 42. The outlet passage 44 may carry outgoing fluid-flow expelled out of the pump assembly 10, and may communicate with the first and second primary passages 46, 48 at a location downstream that at which the inlet passage 42 communicates with the first and second primary passages. The outlet passage 44 may be defined by an outlet surface 52, and, like the inlet passage 42, may have a generally cylindrical shape.

The first and second primary passages 46, 48 may carry fluid-flow through the pump assembly 10 as the fluid-flow travels from the inlet passage 42 and to the outlet passage 44. Referring to FIG. 6, in assembly the first primary passage 46 may be defined in part by a first primary surface 54 that, in this embodiment, may be located in the body piece 32 and may be formed by the first bulged portion 38. The first axial face 28 of the impeller 12 may also define a part of the first primary passage 46. Likewise, the second primary passage 48 may be defined in part by a second primary surface 56 that, in this embodiment, may be located in the cover piece 34 and may be formed by the second bulged portion 40. The second axial face 30 of the impeller 12 may also define a part of the second primary passage 48. In cross-sectional profile like that shown in FIG. 6, each of the first and second primary passages 46, 48 may have a generally half-circle shape. From the inlet passage 42 to the outlet passage 44, each of the first and second primary passages 46, 48 may have an abridged generally half-torus shape. Where the first primary passage 46 initially communicates with the inlet passage 42, the first primary surface 54 and the inlet surface 50, in a sense, may be continuous extensions of each other—that is to say, the transition between the surfaces 50, 54 may be without structures that could interfere with fluid-flow from the inlet passage and to the first primary passage. Similarly, where the second primary passage 48 initially communicates with the inlet passage 42, the second primary surface 56 and the inlet surface 50 may be continuous extensions of each other. The first and second primary passages 46, 48 may each be open to the vanes 22 so that the first and second primary passages can communicate with the spaces located between neighboring individual vanes.

The diverter 18 may be a structure that may be used to veer, obstruct, or both, fluid-flow traveling through the inlet passage 42. In the case of an air pump assembly, air flow may principally make its way into the spaces located between neighboring individual vanes 22 via the first and second primary passages 46, 48 at the first and second axial faces 28, 30 of the impeller 12. It has been found that turbulent flow may be generated by initial impingement between incoming fluid-flow and the terminal ends 24 of the rotating vanes 22, and it has been found that turbulent flow may be generated by initial impingement between incoming fluid-flow and the rotating vanes at the first and second axial faces 28, 30. The turbulent flow can spread beyond the region of immediate impingement and can interfere with and impede fluid-flow entering the first and second primary passages 46, 48 from the inlet passage 42 at entrances 62, 64 thereof (FIG. 6). The diverter 18 may therefore veer fluid-flow away from impingement with the terminal ends 24 and/or impingement with the axial faces 28, 30, may be an obstruction to impingement, or both, to thereby limit or altogether eliminate turbulent flow generated thereat. Fluid-flow may then enter the first and second primary passage 46, 48, with greater ease and yielding improved fluid-flow efficiencies by as much as approximately eleven percent over known inlet designs without diverters; fluid-flow improvements greater than eleven percent may also be possible.

Figure 5:
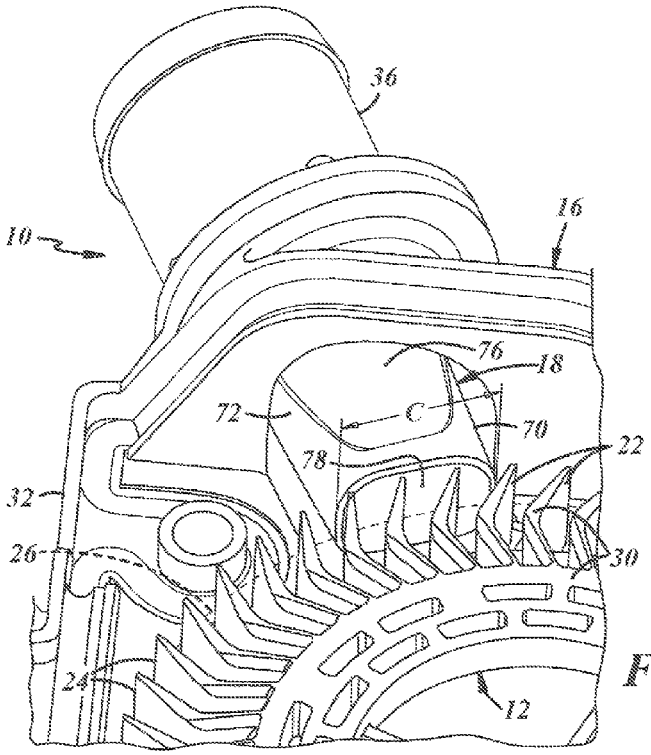
FIG. 5 is an enlarged view of the air pump assembly of FIG. 1 with a cover removed to show an impeller.

The diverter 18 may have different designs and constructions, including that shown by a first embodiment in FIGS. 4, 5, and 6. The diverter 18 may be made of a plastic material, and may be formed by an injection molding process. The diverter 18 may be located in the inlet passage 42, and may be attached to or extend from the inlet piece 36 at the inlet surface 50, or may be attached to or extend from the body piece 32 or the cover piece 34. The diverter 18 may have a longitudinal axis $L_2$ that may be in alignment with the longitudinal axis $L_1$ of the inlet passage 42, and may also be in alignment with an imaginary radius of the impeller 12 that is positioned at an axial centerline of the impeller. In the inlet passage 42, in the first embodiment, the diverter 18 may be positioned so that it does not directly obstruct the entrances 62, 64 from fluid-flow into the first and second primary passage 46, 48 from a generally radial incoming direction.

Referring to FIGS. 4-6, in the first embodiment the diverter 18 may have a generally triangular or cone shape. The diverter 18 may have a first radial end 66 and a second radial end 68, and may have a first circumferential end 70 and a second circumferential end 72. The first radial end 66 may be rounded to facilitate fluid-flow over it. Further, the diverter 18 may have a first face surface 74 and a second face surface 76, and may have a confrontation surface 78. The first face surface 74 may be directed generally axially upwardly, and the second face surface 76 may be directed generally axially downwardly. In this first embodiment, the first and second face surfaces 74, 76 may be generally planar, and may diverge away from each other from the first radial end 66 toward the second radial end 68, which may form a tapered profile from the second radial end to the first radial end.

The confrontation surface 78 may directly confront the terminal ends 24 of the vanes 22 and the circumferential periphery 26 via a radial space. The radial space may have a radial length B that may be maintained at a constant dimension along its axial extent between the edges of the first and second face surfaces 74, 76 at the confrontation surface 78, and may be maintained at a constant dimension along its circumferential extent between the edges of the first and second circumferential ends 70, 72 in which case the confrontation surface may have a bowed and curved profile that follows the profile of the circumferential periphery 26. In another embodiment, for example, the confrontation surface 78 may be generally planar in which case the radial length B dimension has a greater value at the edges of the first and second circumferential ends 70, 72 than at a circumferential centerpoint between the edges of the first and second circumferential ends. The radial length B may have a value that is less than a radial length of the diverter 18, and, in one example, the radial length B may be approximately 0.6 mm or 1.0 mm; in other examples, other values for the radial length B are possible including values less than 0.6 mm, greater than 1.0 mm, or between 0.6 mm and 1.0 mm. The confrontation surface 78 may be arranged generally axially, and may have an axial height dimension that may be approximately equal to the axial height dimension A of the vanes 22 at the terminal ends 24. Further, the confrontation surface 78 may have a circumferential width dimension C that may be substantially equal to or less than the diameter of the inlet passage 42. The confrontation surface 78, the circumferential periphery 26, and the radial space therebetween, may constitute a confrontation region between the impeller 12 and the diverter 18.

In use, fluid-flow is drawn into the inlet passage 42 via the rotating impeller 12. As the fluid-flow encounters the diverter 18, a portion of fluid-flow F (FIG. 6) may be veered to the first primary passage 46 via the first face surface 74, and a portion of the fluid-flow F may be veered to the second primary passage 48 via the second face surface 76. Because the diverter 18—and in particular the confrontation surface 78—may obstruct impingement between incoming fluid-flow F and the terminal ends 24 of the vanes 22, turbulent flow is limited or altogether eliminated thereat and the fluid-flow enters the first and second primary passages 46, 48 substantially unimpeded by the turbulent flow that would otherwise be generated without use of the diverter. In one embodiment, the circumferential width C of the diverter 18 may be substantially equal to or greater than the corresponding circumferential width of the first and second primary passages 46, 48 at their entrances 62, 64, and the diverter may be positioned in circumferential alignment with the entrances of the first and second primary passages so that turbulent flow may be particularly limited or altogether eliminated thereat.

Figure 7:
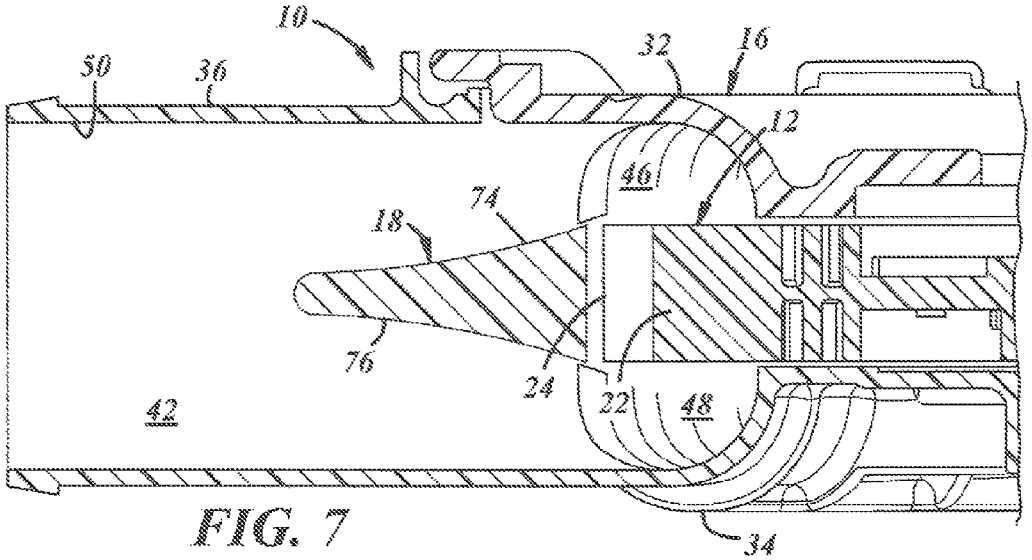
FIG. 7 is a cross-sectional view similar to that of FIG. 6, showing another embodiment of a diverter.

FIG. 7 shows a second embodiment of the pump assembly 10. The second embodiment is similar to the first embodiment in many ways, and the similarities may not necessarily be repeated here for the second embodiment. One difference is the diverter 18. In FIG. 7, the diverter 18 may have first and second face surfaces 74, 76 that may be concave in cross-sectional profile as shown in the figure. In other words, the first and second face surfaces 74, 76 may have a bowed or curved cross-sectional profile. The cross-sectional profile of the diverter 18 in the second embodiment may facilitate fluid-flow thereover.

Figure 8:
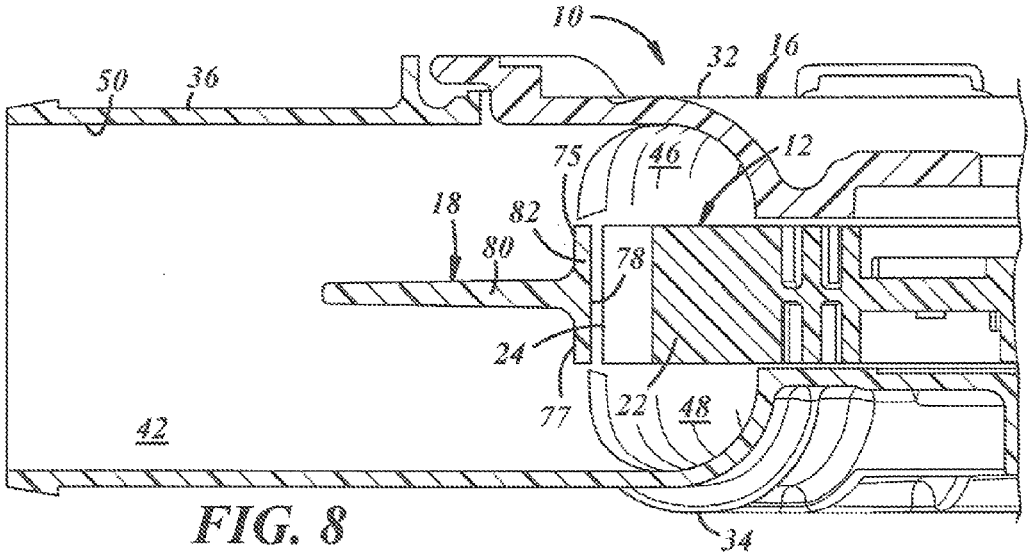
FIG. 8 is a cross-sectional view similar to that of FIG. 6, showing another embodiment of a diverter.

FIG. 8 shows a third embodiment of the pump assembly 10. The third embodiment is similar to the first embodiment in many ways, and the similarities may not necessarily be repeated here for the third embodiment. One difference is the diverter 18. In FIG. 8, the diverter 18 may have a generally T-shape with a stem portion 80 and a head portion 82. The head portion 82 may have a greater axial height dimension than the stem portion 80, and the axial height dimension of the head portion may be approximately equal to the axial height dimension of the vanes 22 at the terminal ends 24. The head portion 82 may have a first and second face surface 75, 77 that may be arranged generally axially like the confrontation surface 78. In use in the third embodiment, incoming fluid-flow may impinge the first and second face surfaces 75, 77, and some turbulent flow may be generated thereat. The amount of turbulent flow generated, however, may be less than that generated by impingement between incoming fluid-flow and the terminal ends 24 of the rotating vanes 22 in the known inlet design without a diverter, and may therefore be acceptable in at least some applications.

Figure 9:
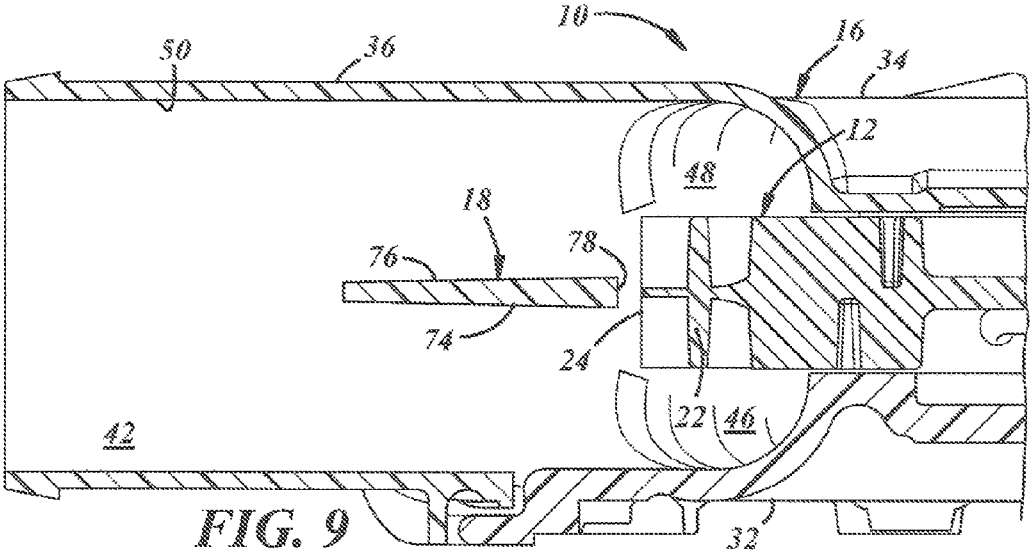
FIG. 9 is a cross-sectional view similar to that of FIG. 6, showing another embodiment of a diverter.

FIG. 9 shows a fourth embodiment of the pump assembly 10. The fourth embodiment is similar to the first embodiment in many ways, and the similarities may not necessarily be repeated here for the fourth embodiment. One difference is the diverter 18. In FIG. 9, the housing 16 has been turned one-hundred-and-eighty degrees relative to the depiction in FIG. 6. The diverter 18 in the fourth embodiment may have first and second face surfaces 74, 76 that may be generally planar and may be arranged generally radially. The confrontation surface 78 may have an axial height dimension that may be less than the axial height dimension of the vanes 22 at the terminal ends 24, and may be less than approximately one-half the axial height dimension of the vanes at the terminal ends. In use in the fourth embodiment, incoming fluid-flow may impinge the terminal ends 24 of the vanes 22 at locations where the confrontation surface 78 does not confront the terminal ends, and some turbulent flow may be generated thereat. The amount of turbulent flow generated, however, may be less than that generated by impingement between incoming fluid-flow and the terminal ends 24 of the rotating vanes 22 in the known inlet design without a diverter, and may therefore be acceptable in at least some applications.

Figure 10:
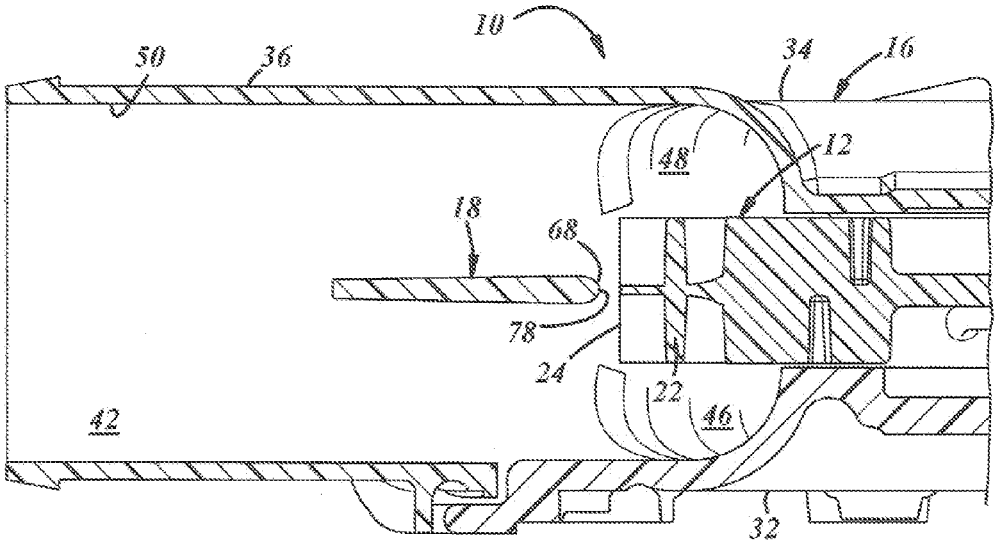
FIG. 10 is a cross-sectional view similar to that of FIG. 6, showing another embodiment of a diverter.

FIG. 10 shows a fifth embodiment of the pump assembly 10. The fifth embodiment is similar to the fourth embodiment. One difference is the second radial end 68 and the confrontation surface 78 of the diverter 18. The second radial end 68 may have a rounded profile, and the confrontation surface 78 may therefore also have a rounded profile.

Figure 11:
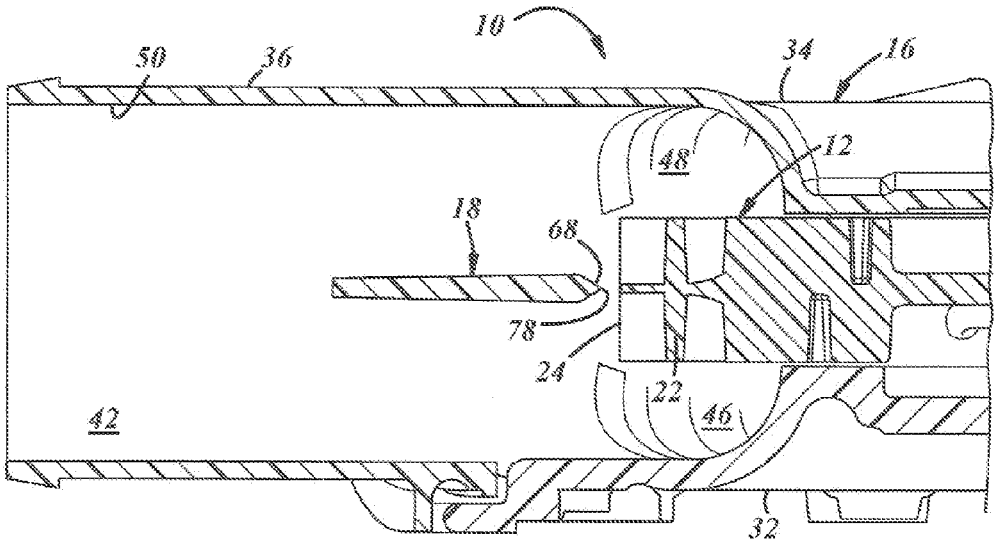
FIG. 11 is a cross-sectional view similar to that of FIG. 6, showing another embodiment of a diverter.

FIG. 11 shows a sixth embodiment of the pump assembly 10. The sixth embodiment is similar to the fourth embodiment. One difference is the second radial end 68 and the confrontation surface 78 of the diverter 18. The second radial end 68 may have a pointed profile, and the confrontation surface 78 may therefore also have a pointed profile.

Figure 12:
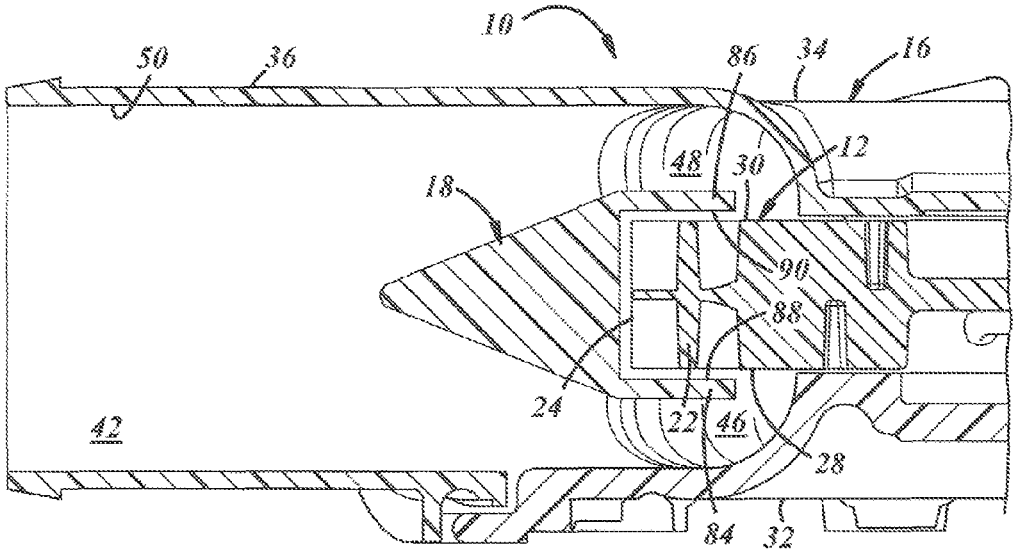
FIG. 12 is a cross-sectional view similar to that of FIG. 6, showing another embodiment of a diverter.

FIG. 12 shows a seventh embodiment of the pump assembly 10. The seventh embodiment is similar to the first embodiment in many ways, and the similarities may not necessarily be repeated here for the seventh embodiment. One difference is the diverter 18. In FIG. 12, the diverter 18 may have a first extension or second diverter 84 and may have a second extension or third diverter 86. The second and third diverters 84, 86 may extend generally radially from the remaining portion of the diverter 18. The second diverter 84 may have a second confrontation surface 88, and the third diverter may have a third confrontation surface 90. The second confrontation surface 88 may directly confront the first axial face 28 of the impeller 12 via an axial space, and the third confrontation surface 90 may directly confront the second axial face 30 via an axial space. The axial spaces may have a value of approximately 0.35 mm, 0.6 mm, 1.0 mm, or some other value more, less, or somewhere in between these values. The second and third confrontation surfaces 88, 90 may each have a radial length dimension that may be approximately equal to a radial length dimension of the vanes 22 so that the second and third diverters 84, 86 may radially overlap the radial extent of the vanes; in other embodiments, the radial length dimensions of the second and third confrontation surfaces may be greater or less than that of the vanes. Further, the Confrontation surfaces 88, 90 may have a circumferential width dimension that may be substantially equal to that of the remaining portion of the diverter 18, that may be substantially equal to or less than the diameter of the inlet passage 42, or that may be substantially equal to the circumferential widths of the first and second primary passages 46, 48 at their entrances 62, 64. In use, the second and third confrontation surfaces 88, 90 may obstruct impingement between incoming fluid-flow and the axial faces 28, 30 of the rotating vanes 22, turbulent flow may be limited or altogether eliminated thereat, and the fluid-flow may enter the first and second primary passages 46, 48 substantially unimpeded by the turbulent flow that would otherwise be generated without use of the second and third. diverters 84, 86. The functionality of the remaining portion of the diverter 18 with respect to the circumferential periphery 26 has been previously described. In alternatives to the seventh embodiment, only one of the second and third diverters 84, 86 need be provided and not necessarily both of them.

Figure 13:
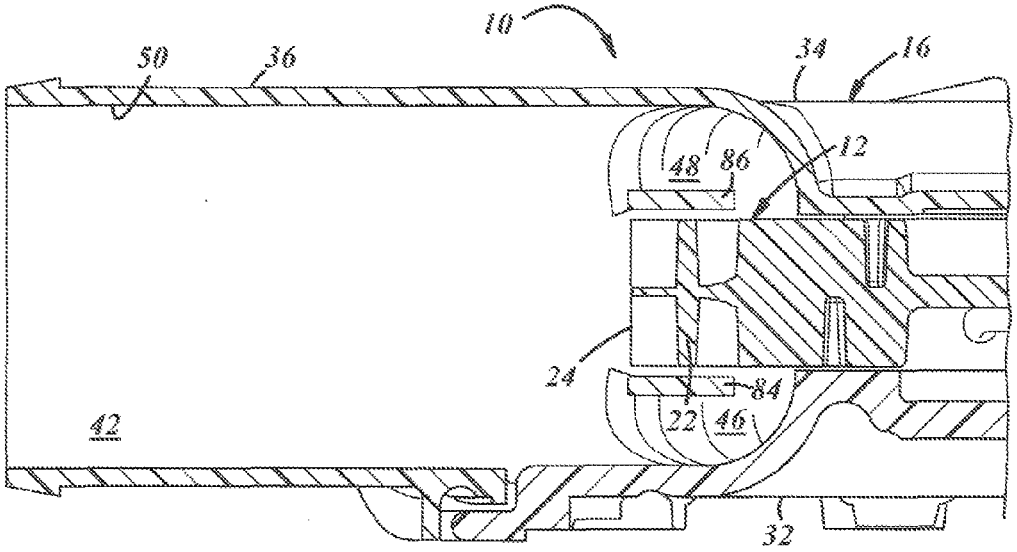
FIG. 13 is a cross-sectional view similar to that of FIG. 6, showing another embodiment of a diverter.

FIG. 13 shows an eighth embodiment of the pump assembly 10. The eighth embodiment is similar to the seventh embodiment. One difference is that the remaining portion of the diverter 18 is not provided, leaving only the second and third diverters 84, 86.

In other embodiments not shown in the figures, for example, the longitudinal axis of the diverter need not be in alignment with the longitudinal axis of the inlet passage, and instead the diverter of FIG. 9 could be slanted such that its axial height measured in the axial direction from its first radial end to its second radial end is approximately equal to the axial height of the vanes.

The following is a description of select illustrative embodiments within the scope of the invention. The invention is not, however, limited to this description; and each embodiment and components, elements, and steps within each embodiment may be used alone or in combination with any of the other embodiments and components, elements, and steps within the other embodiments.

Embodiment one may include an air pump assembly. The air pump assembly may comprise an impeller, a housing, and a diverter. The impeller may have an axial face, an axis of rotation, and a circumferential periphery. The housing may surround the impeller, and may form a part or more of a primary passage. The primary passage may be open to the impeller at the axial face. The housing may have an inlet passage that may communicate with the primary passage.

The inlet passage may have a longitudinal axis that may be arranged generally orthogonal to the axis of rotation of the impeller. The diverter may be located near or closer to the inlet passage. The diverter may have a surface that may confront the axial face of the impeller, may confront the circumferential periphery of the impeller, or may confront both the axial face and the circumferential periphery. During use of the air pump assembly, the diverter may inhibit the generation of turbulent flow between incoming air and the impeller where the surface confronts the impeller.

Embodiment two, which may be combined with embodiment one, further describes that the air pump assembly may include a motor connected to the impeller to rotate the impeller during use of the air pump assembly.

Embodiment three, which may be combined with any one of embodiments one and two, further describes that the axial face may include a first axial face and a second axial face. The primary passage may include a first primary passage and a second primary passage. The first primary passage may be open to the impeller at the first axial face and the second primary passage may be open to the impeller at the second axial face. The inlet passage may communicate with the first and second primary passages.

Embodiment four, which may be combined with any one of embodiments one, two, and three, further describes that the housing may include a body piece and a cover piece that are attached together.

Embodiment five, which may be combined with any one of embodiments one, two, three, and four, further describes that the surface of the diverter confronts the circumferential periphery and may have an axial height dimension that may be greater than approximately one-half an axial height dimension of the impeller at the circumferential periphery.

Embodiment six, which may be combined with any one of embodiments one, two, three, four, and five, further describes that the surface of the diverter confronts the circumferential periphery and may be spaced radially from the circumferential periphery by a distance that may be less than a radial length dimension of the diverter.

Embodiment seven, which may be combined with any one of embodiments one, two, three, four, five, and six, further describes that the surface of the diverter confronts the circumferential periphery and that a distance of a radial space between the surface of the diverter and the circumferential periphery may be maintained generally constant from a first circumferential end of the diverter to a second circumferential end of the diverter.

Embodiment eight, which may be combined with any one of embodiments one, two, three, four, five, six, and seven, further describes that the surface of the diverter confronts the circumferential periphery of the impeller and may have a circumferential width dimension that may be greater than approximately one-half a diameter dimension of the inlet passage.

Embodiment nine, which may be combined with any one of embodiments one, two, three, four, five, six, seven, and eight, further describes that the surface of the diverter confronts the circumferential periphery of the impeller and may have an axial height dimension that may be greater than an axial height dimension of an end of the diverter that is initially impinged by incoming air flow flowing through the inlet passage.

Embodiment ten, which may be combined with any one of embodiments one, two, three, four, five, six, seven, eight, and nine, further describes that the surface of the diverter confronts the circumferential periphery and that the diverter may have a first face surface and a second face surface. The first and second face surfaces may diverge away from each other in a direction toward the surface of the diverter confronting the circumferential periphery of the impeller.

Embodiment eleven, which may be combined with any one of embodiments one, two, three, four, five, six, seven, eight, nine, and ten, further describes that the surface of the diverter confronts the axial face of the impeller and confronts a portion or more of a radial extent of a plurality of vanes of the impeller.

Embodiment twelve may include a method. The method may comprise providing an air pump assembly that may comprise an impeller and a housing. The housing may surround the impeller. The impeller may have numerous vanes, an axial face, and an axis of rotation. The vanes may have a circumferential periphery. The housing may form a part or more of a primary passage, and the primary passage may be open to the vanes at the axial face. The housing may have an inlet passage that, may have a longitudinal axis that may be arranged generally orthogonal to the axis of rotation of the impeller. The method may further comprise diverting a portion or more of incoming air flow traveling through the inlet passage away from the circumferential periphery of the vanes, away from the axial face of the impeller, or away from both of the circumferential periphery and the axial face.

Embodiment thirteen, which may be combined with embodiment twelve, further describes diverting a portion or more of incoming air flow by way of a diverter that may be located partially or more within the inlet passage. The diverter may have a greatest axial height dimension that may be greater than approximately one-half an axial height dimension of the vanes at the circumferential periphery.

Embodiment fourteen, which may be combined with any one of embodiments twelve and thirteen, further describes diverting a portion or more of incoming air flow by way of a diverter that may be located partially or more within the inlet passage. The diverter may have a greatest circumferential width dimension that may be greater than approximately one-half a diameter dimension of the inlet passage.

Embodiment fifteen may include an air pump assembly. The air pump assembly may comprise an impeller, a motor, a housing, and a diverter. The impeller may have numerous vanes, a first axial face, a second axial face, and an axis of rotation. The vanes may have a circumferential periphery. The motor may be connected to the impeller in order to rotate the impeller when the air pump assembly is in use. The housing may surround the impeller. The housing may form a part or more of a first primary passage. The first primary passage may be open to the vanes at the first axial face. The housing may form a part or more of a second primary passage. The second primary passage may be open to the vanes at the second axial face. The housing may have an inlet passage that may communicate with the first and second primary passages. The housing may have an outlet passage that may communicate with the first and second primary passages. The inlet passage may have a longitudinal axis that may be arranged generally orthogonal to the axis of rotation of the impeller. The diverter may have a surface confronting the circumferential periphery of the vanes. The surface may have an axial height dimension that may be greater than approximately one-half an axial height dimension of the vanes at the circumferential periphery. The surface may have a circumferential width dimension that may be greater than approximately one-half a diameter dimension of the inlet passage. When the air pump assembly is in use, the diverter may inhibit incoming air flow at the circumferential periphery of the vanes where the surface confronts the circumferential periphery, and the diverter may veer incoming air flow to the first and second primary passages.

The above description of embodiments of the invention is merely illustrative in nature and, thus, variations thereof are not to be regarded as a departure from the spirit and scope of the invention.

What is claimed is:

1. A product comprising:

a regenerative air pump assembly comprising:

an impeller having an axial face, an axis of rotation, and a circumferential periphery;

a housing surrounding the impeller;

an inlet and an outlet passage formed in the housing for receiving and delivering a fluid, the inlet passage having a longitudinal axis arranged generally orthogonal to the axis of rotation of the impeller;

at least one primary passage being open to the impeller at the axial face of the impeller and extending between the inlet passage and the outlet passage and having a cross-section defined by the axial face of the impeller and a primary surface of the housing;

wherein the cross-section of the at least one primary passage is essentially the same from the inlet passage to the outlet passage; and a diverter located at least adjacent the inlet passage, the diverter having a surface confronting the axial face of the impeller, confronting the circumferential periphery of the impeller, or confronting the axial face and the circumferential periphery of the impeller, wherein, during use of the air pump assembly, the diverter inhibits generation of turbulent flow between the incoming fluid flow and the impeller where the diverter surface confronts the impeller.

2. A product as set forth in claim 1 wherein the air pump assembly comprises a motor connected to the impeller to rotate the impeller during use of the air pump assembly.

3. A product as set forth in claim 1 wherein the housing comprises a body piece and a cover piece that are attached together.

4. A product as set forth in claim 1 wherein the surface of the diverter confronts the circumferential periphery of the impeller and has an axial height dimension that is greater than approximately one-half an axial height dimension of the impeller at the circumferential periphery.

5. A product as set forth in claim 1 wherein the surface of the diverter confronts the circumferential periphery of the impeller and is spaced radially from the circumferential periphery by a distance that is less than a radial length dimension of the diverter.

6. A product as set forth in claim 5 wherein the distance of the radial space between the surface of the diverter and the circumferential periphery of the impeller is maintained generally constant from a first circumferential end of the diverter to a second circumferential end of the diverter.

7. A product as set forth in claim 1 wherein the surface of the diverter confronts the circumferential periphery of the impeller and has a circumferential width dimension that is greater than approximately one-half a diameter dimension of the inlet passage.

8. A product as set forth in claim 1 wherein the surface of the diverter confronts the circumferential periphery of the impeller and has an axial height dimension that is greater than an axial height dimension of an end of the diverter that is initially impinged by the incoming air flow flowing through the inlet passage.

9. A product as set forth in claim 8 wherein the diverter has a first face surface and a second face surface, the first and second face surfaces of the diverter diverging away from each other in a direction toward the surface of the diverter confronting the circumferential periphery of the impeller.

10. The product of claim 9 wherein the first and the second face surfaces of the diverter are concave.

11. The product of claim 9, wherein the diverter further includes a first extension and a second extension, wherein the axial face includes a first axial face and a second axial face, and wherein the first extension faces a portion of the first axial face and the second extension faces a portion of the second axial face.

12. The product of claim 8 wherein the diverter is generally T-shaped.

13. A product as set forth in claim 1 wherein the surface of the diverter confronts the axial face of the impeller and confronts at least a portion of a radial extent of a plurality of vanes of the impeller.

14. The product of claim 1 wherein a greatest axial height of the diverter is less than half the axial height dimension of the impeller.

15. The product of claim 1 wherein the diverter comprises a first diverter and a second diverter, wherein the first diverter and the second diverter are separate components, wherein the axial face includes a first axial face and a second axial face, and wherein the first diverter confronts the first axial face and the second diverter confronts the second axial face.

16. The product of claim 1 further comprising a second axial face of the impeller, and wherein a second primary passage being open to the impeller at the second axial face extends between the inlet passage and the outlet passage.

17. A method comprising:

providing a regenerative air pump assembly comprising an impeller having an axial face, an axis of rotation, and a circumferential periphery; a housing surrounding the impeller, an inlet passage and an outlet passage formed in the housing for receiving and delivering a fluid, the inlet passage having a longitudinal axis arranged generally orthogonal to the axis of rotation of the impeller; at least one primary passage being open to the impeller at the axial face and extending between the inlet passage and the outlet passage and having a cross-section defined by the axial face of the impeller and a primary surface of the housing; wherein the cross-section of the at least one primary passage is essentially the same from the inlet passage to the outlet passage; and diverting at least a portion of incoming fluid flow through the inlet passage directly into the at least one primary passage and away from the circumferential periphery of the impeller, away from the axial face of the impeller, or away from both the circumferential periphery and the axial face of the impeller.

18. A method as set forth in claim 17 further comprising diverting at least a portion of incoming air flow via a diverter located at least partially within the inlet passage, the diverter having a greatest axial height dimension greater than approximately one-half an axial height dimension of the impeller at the circumferential periphery of the impeller.

19. A method as set forth in claim 17 further comprising diverting at least a portion of incoming air flow via a diverter located at least partially within the inlet passage, the diverter having a greatest circumferential width dimension greater than approximately one-half a diameter dimension of the inlet passage.

20. A product comprising:

a regenerative air pump assembly comprising:

an impeller having a plurality of vanes, a first axial face, a second axial face, and an axis of rotation, the plurality of vanes having a circumferential periphery;

a motor connected to the impeller to rotate the impeller during use of the air pump assembly;

a housing surrounding the impeller, an inlet passage and an outlet passage formed in the housing for receiving and delivering a fluid, the inlet passage having a longitudinal axis arranged generally orthogonal to the axis of rotation of the impeller;

a first primary passage being open to the impeller at the first axial face and extending between the inlet passage and the outlet passage and having a first cross-section defined by the first axial face of the impeller and a first primary surface of the housing and;

a second primary passage being open to the impeller at the second axial face and extending between the inlet passage and the outlet passage and having a second cross-section defined by the second axial face of the impeller and a second primary surface of the housing;

wherein the first cross-section of the first primary passage is essentially the same from the inlet passage to the outlet passage and the second cross-section of the secondary primary passage is essentially the same from the inlet passage to the outlet passage; and a diverter having a surface confronting the circumferential periphery of the plurality of vanes, the surface having an axial height dimension greater than approximately one-half an axial height dimension of the plurality of vanes at the circumferential periphery, the surface having a circumferential width dimension greater than approximately one-half a diameter dimension of the inlet passage, wherein, during use of the air pump assembly, the diverter inhibits incoming air flow at the circumferential periphery of the plurality of vanes where the surface confronts the circumferential periphery, and the diverter veers incoming air flow to the first and second primary passages.

* * * * *